United States Patent [19]

Masaka et al.

[11] Patent Number: 5,039,839

[45] Date of Patent: Aug. 13, 1991

[54] DIESEL ENGINE GLOW PLUG WITH SELF-TEMPERATURE SATURATION CHARACTERISTIC AND EXTENDED AFTER-GLOW-TIME

[75] Inventors: Mitsusuke Masaka; Koji Hatanaka, both of Saitama, Japan

[73] Assignee: Jidosha Kiki Co., Ltd., Tokyo, Japan

[21] Appl. No.: 460,696

[22] Filed: Jan. 4, 1990

[30] Foreign Application Priority Data

Feb. 15, 1989 [JP] Japan ..... 1-35652

[51] Int. Cl.[5] ..... F02P 19/02; F23Q 7/22; H05B 3/00

[52] U.S. Cl. ..... 219/270; 123/145 A; 219/544; 219/553

[58] Field of Search ..... 219/260-220, 219/544, 553; 361/264-266; 123/145 R, 145 A

[56] References Cited

U.S. PATENT DOCUMENTS 4,556,781 12/1985 Bauer ..... 123/145 A
4,636,114 1/1987 Itoh et al. ..... 219/270
4,725,711 2/1988 Minegishi et al. ..... 219/270
4,733,053 3/1988 Mueller ..... 219/270

FOREIGN PATENT DOCUMENTS 60-86327 5/1985 Japan ..... 219/270
62-194117 8/1987 Japan ..... 219/270
63-60289 11/1988 Japan .

*Primary Examiner*—Anthony Bartis
*Attorney, Agent, or Firm*—Townsend & Townsend

[57] ABSTRACT

A glow plug for a diesel engine includes a first resistor serving as a heating element, second and third resistors, a sheath which incorporates the first, second, and third resistors, a heat-resistant insulating powder filled in the sheath to insulate the first, second, and third resistors from each other, and a cylindrical housing for holding the sheath. The second and third resistors are connected in series with the first resistor, are made of a material having a positive resistance-temperature coefficient, and have a positive resistance-temperature coefficient larger than that of the first resistor. The heat capacity of a given sheath portion having the third resistor therein is set larger than that of the other sheath portions.

7 Claims, 3 Drawing Sheets

DIESEL ENGINE GLOW PLUG WITH SELF-TEMPERATURE SATURATION CHARACTERISTIC AND EXTENDED AFTER-GLOW-TIME

BACKGROUND OF THE INVENTION

The present invention relates to a glow plug used for preheating a subcombustion or combustion chamber of a diesel engine and, more particularly, to a self-temperature control diesel engine glow plug which performs fast heating, has a self-temperature saturation characteristic, and achieves after glow for a long period of time.

A diesel engine generally has a poor ignition characteristic at low temperatures. Therefore, a glow plug is attached to each subcombustion or combustion chamber. The glow plug is supplied with a current to increase an air intake temperature or serves as an ignition source so as to improve the ignition characteristic of the engine. Various types of conventional glow plugs are known. For example, the present applicant proposed a self-temperature control glow plug elaborately incorporating a resistor consisting of two types of materials, thereby obtaining stable heating characteristics so as to obtain a fast heating characteristic and prevent overheating of a heating element, as in Japanese Patent Laid-Open No. 57-182026.

In a glow plug of this type, a first resistor serving as a heating element and a second resistor connected in series therewith and consisting of a material having a positive resistance-temperature coefficient larger than that of the first resistor are embedded in a heat-resistant insulating powder in a sheath. A gap is formed between the first and second resistors to provide a time lag of heat conduction from the first resistor. A necessary high power is supplied to the first resistor upon its energization to quickly heat the first resistor, thereby assuring fast heating. At the same time, an increase in resistance of the second resistor upon an increase in temperature causes reduction of the power supplied to the first resistor after a lapse of a predetermined period of time. Melting of the first resistor which is caused by overheating can therefore be prevented, thus achieving the self-temperature saturation characteristic. With the glow plug having such a structure, a temperature control means or the like for controlling power supply to an energization circuit for a conventional glow plug must be arranged, and the total cost of the preheating unit becomes high.

In the conventional glow plug described above, although the fast heating function and the self-temperature saturation function can be assured to some extent, it is difficult to provide a heating characteristic for reducing a heating temperature in an after glow state upon starting of the engine. An after glow state lasts about several tens of seconds in the conventional glow plug. Strong demand has arisen for prolonging the after glow time over 10 minutes. No conventional glow plug can satisfy this demand. In order to perform the after glow operation for such a long period of time while the heating temperature is gradually reduced, a voltage drop resistor, a relay, and the like must be arranged in the energization circuit for the glow plug, and the circuit cost becomes high.

In order to allow the after glow for a long period of time by a glow plug itself without adding elements to the circuit, the energization power supplied to the heating element must be self-controlled to greatly improve the heating characteristics so as to prevent overheating of a heater portion. At the same time, a saturation temperature must be reduced to an appropriate temperature or less to assure durability of the heating wire and to maintain its temperature, thereby providing the self-temperature control function. In consideration of the above situation, demand has arisen for a glow plug having a heater portion having fast heating and self-temperature saturation functions and excellent reliability such as high heat resistance.

The present applicant proposed a glow plug structure to solve the above problem in Japanese Patent Laid-Open No. 60-117030. In this glow plug, second and third resistors made of a material having a positive resistance-temperature coefficient larger than that of a first resistor serving as a heating element are connected in series with the first resistor. The temperature rise of the third resistor is lagged from that of the second resistor, Therefore, the power supplied to the first resistor serving as the heating element in the after glow state is lower than that corresponding to the saturation temperature at the time of the start of the engine. In this structure, however, since a sheath in which the first, second, and third series-connected resistors are embedded in a heat-resistant insulating powder is straight, and the sheath has the same diameter along its longitudinal direction, a heat capacity of the second and third resistors serving as a control side is almost equal to that of the first resistor serving as the heating element. In addition, energization control is performed without considering the magnitudes of the positive resistance-temperature coefficients of the second and third resistors. Therefore, the increases in temperature of the second and third resistors do not cause a great time lag. This conventional glow plug is insufficient to obtain appropriate heating characteristics for reducing a heating temperature, assuring durability of resistors, and realizing the after glow for a long period of time.

Still another conventional glow plug is proposed in Japanese Utility Model Laid-Open No. 61-181957. In this glow plug, a second resistor having better heat-resistant, anti-corrosion properties than those of a third resistor and having a positive resistance-temperature coefficient is interposed between the third resistor located on the control side and a first resistor serving as a heating element. This glow plug solves a durability problem posed by the fact that the second resistor is excessively heated by a thermal influence of the first resistor and heat generated by the second resistor itself. This glow plug cannot achieve the after glow for a long period of time and cannot provide necessary heating characteristics. Some countermeasures must be taken to solve the problems described above in consideration of the above situation.

SUMMARY OF THE INVENTION

It is an object of the present invention to provide a glow plug for a diesel engine which can perform faster heating than a conventional glow plug and temperature control at an appropriate saturation temperature, thereby achieving the after glow for a long period of time.

In order to achieve the above object of the present invention, there is provided a glow plug for a diesel engine, comprising a first resistor serving as a heating element, and second and third a resistors connected in series with the first resistor. All three resistors are made of a material having a positive resistance-temperature coefficient, and the resistance-temperature coefficients of the second and third resistors are larger than that of the first resistor. A sheath incorporates the first, second, and third resistors, and a heat-resistant insulating powder is filled in the sheath to insulate the first, second, and third resistors from each other. The sheath is held in a cylindrical housing and means for increasing the heat capacity is arranged at a given sheath portion having the third resistor therein to increase the heat capacity of the given sheath portion over that of other sheath portions.

According to the present invention, energization control of the first resistor serving as a heating element is performed by the second resistor located near the first resistor. Fast heating and temperature control at an appropriate saturation temperature are performed. The temperature of the third resistor spaced apart from the first resistor is gradually increased, and the control function is effected. Therefore, the energization power is reduced, the heating temperature is reduced, and the after glow for a long period of time can be achieved.

DESCRIPTION OF THE PREFERRED EMBODIMENTS

Preferred embodiments of the present invention will be described with reference to the accompanying drawings.

Figure 1:
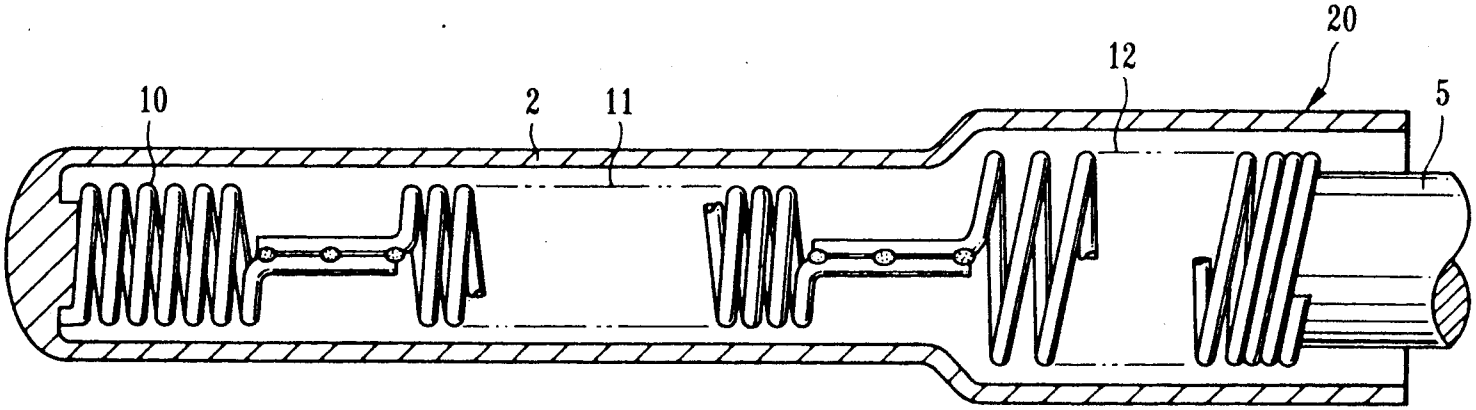
FIG. 1 is an enlarged sectional view showing the main part of a glow plug for a diesel engine according to an embodiment of the present invention.
Figure 2:
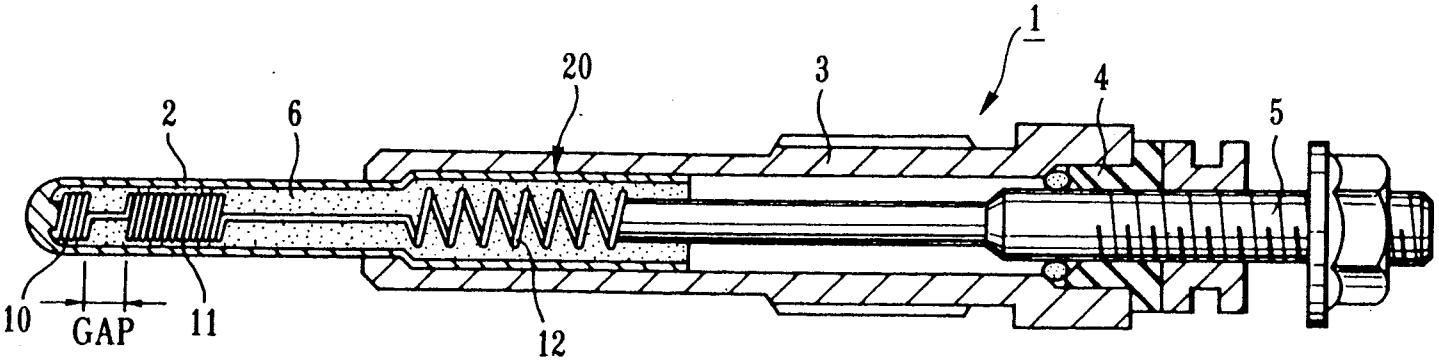
FIG. 2 is a schematic sectional view showing the overall structure of the glow plug.
Figure 3:
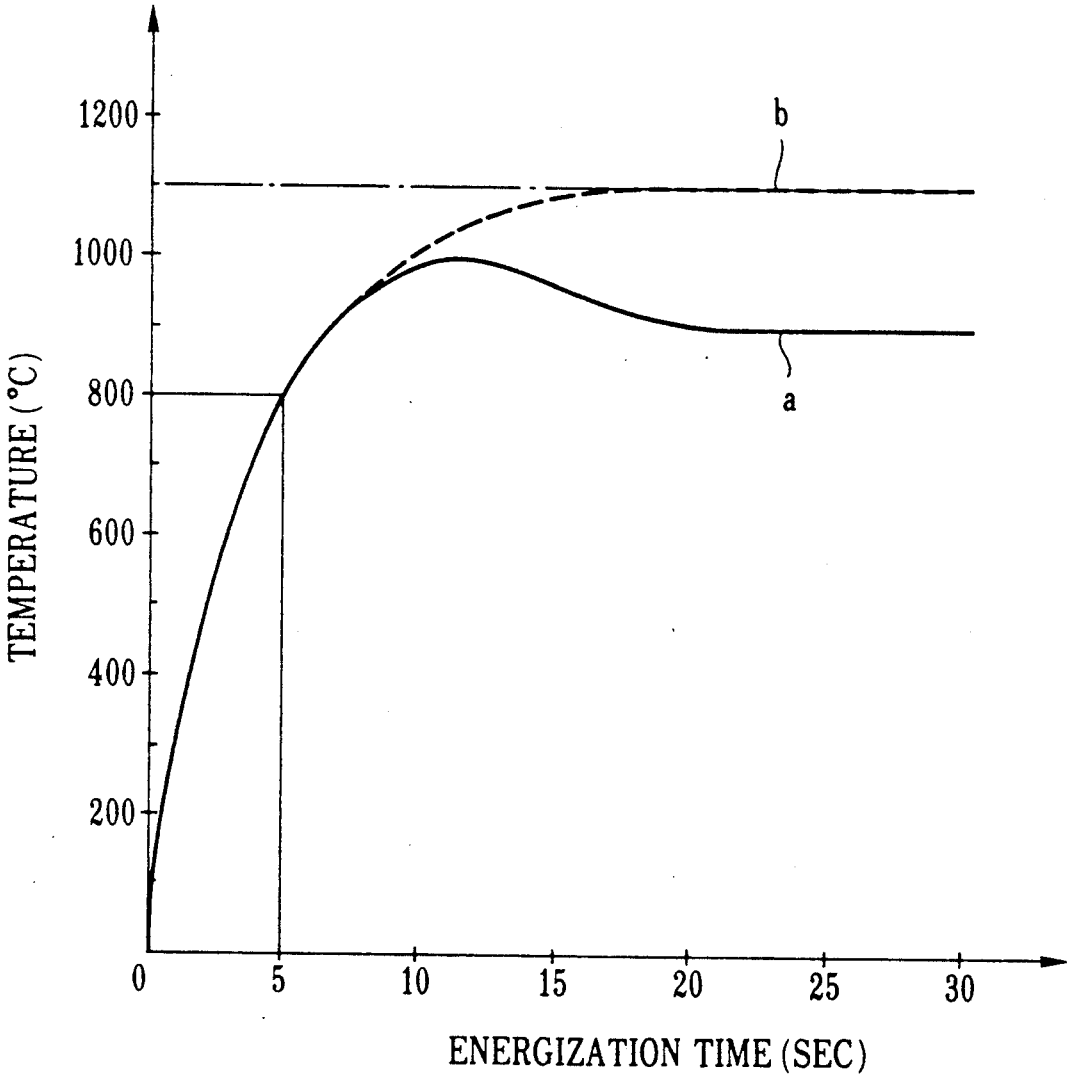
FIG. 3 is a graph for explaining heating characteristics.

FIGS. 1 to 3 show a diesel engine glow plug according to an embodiment of the present invention. A schematic structure of a glow plug denoted by reference numeral 1 will be briefly described. Reference numeral 2 denotes a sheath made of a heat-resistant metal material such as stainless steel; and 3, a housing for holding a rear end portion of the sheath 2. An electrode rod 5 is concentrically mounted at a rear end portion of the housing 3 through an insulating bushing 4. The front end of the electrode rod 5 is inserted into the sheath 2.

A first spiral resistor 10 (to be referred to as a first resistor hereinafter) serving as a heating element made of a conductive material (e.g., an iron-chromium or nickel-chromium alloy) having a small positive resistance-temperature coefficient is arranged in the internal space at the front end of the sheath 2 along the axial direction. One end of the first resistor 10 is electrically connected to the front end of the sheath 2. A second spiral resistor 11 (to be referred to as a second resistor hereinafter) made of a conductive material (e.g., an iron-based material) having a large positive resistance-temperature coefficient and a third spiral resistor 12 (to be referred to as a third resistor hereinafter) made of a conductive material (e.g., nickel or tungsten) having a large positive resistance-temperature coefficient are arranged in the internal space at the rear end of the sheath 2 between the first resistor 10 and the electrode rod 5 continuous with the first resistor 10 on the rear end side of the sheath 2. The second resistor 11 located on the first resistor 10 side is connected in series with the third resistor 12 located on the electrode 5 side. The first, second, and third resistors 10, 11, and 12 are embedded in a heat-resistant insulating powder 6 such as magnesia (MgO) filled in the sheath 2.

The second resistor 11 serves not only as a heat source but also as a temperature control means. The second resistor 11 supplies a high power to the first resistor 10 in the initial period of energization since the resistance of the second resistor 11 is small. When an energization time elapses, the resistance of the second resistor is increased to reduce the supplied power and to set the saturation temperature of the glow plug itself to be a predetermined temperature or less, thereby preventing overheating. These two functions are apparent from the fact that the resistance of the second resistor 11 is gradually increased by heat upon its energization. In order to appropriately perform current control of the second resistor 11, the first resistor 10 and the second resistor 11 are connected such that their spiral portions are spaced apart from each other at a predetermined interval (gap) 14. By providing the predetermined gap 14 between the spiral portions of the resistors 10 and 11, a time lag of a thermal influence from the first resistor 10 to the second resistor 11, which is a problem in a conventional glow plug, can be maintained. Current control by the second resistor 11 is delayed to prolong a time for supplying a high power to the first resistor 10. The first resistor 10 is quickly heated to greatly improve the temperature rise characteristics.

The third resistor 12 connected in series with the rear end of the second resistor 11 performs energization control for the first resistor 10 with a time lag from control by the second resistor 11. In the initial period of energization, since the resistance of the third resistor 12 is small, a high power can be supplied to the second resistor 11 and the first resistor 10. With a lapse of the energization time, the temperature of the third resistor 12 is increased and its resistance is increased accordingly. The power supplied to the first and second resistors 10 and 11 is gradually reduced. Therefore, the third resistor 12 serves as the temperature control means for controlling to maintain the heating temperature of the glow plug to be a predetermined temperature condition. Energization control of the third resistor 12 is lagged from that of the second resistor 11, and power supplied to the first resistor 10 is further reduced. Therefore, the temperature of the glow plug upon starting of the engine can be set to be lower than the saturation temperature by the second resistor 11 during engine operation. In order to perform appropriate current control by the third resistor 12, the second and third resistors 11 and 12 have a gap such that the thermal influence from the second resistor 11 reaches the third resistor 12 with a time lag.

The connection portions within the gaps between the resistors 10 and 11 and between the resistors 11 and 12 are welded with a laser beam such that linear end portions axially extending from the respective last spiral ends of the resistors are set to be parallel to and overlap each other.

According to the characteristic feature of the present invention, in the diesel engine glow plug 1 having the structure described above, a rear end sheath portion embedded with the third resistor 12 has a larger diameter than that of the front end of the sheath 2 in which the first and second resistors 10 and 11 are embedded, as is apparent from FIGS. 1 and 2.

In this embodiment, when the sheath 2 having a large-diameter rear end portion 20 is mounted on the front end portion of the housing 3, the small-diameter portion is inserted into the hole of the front end portion of the housing 3 while the large-diameter portion 20 is locked at a stepped portion of the front end inside the housing 3. However, a method of mounting the sheath 2 is not limited to this method. The sheath 2 may be fixed in the housing 3 by brazing. Alternatively, the large-diameter portion 20 may be pressed into the hole of the front end of the housing. In this embodiment, the third resistor 12 embedded in the large-diameter rear end portion of the sheath 2 has a large coil diameter due to manufacturing advantages.

In order to delay temperature control of the third resistor 12 from control of the second resistor 11, (1) the third resistor 12 is separated farther from the first resistor 10 serving as a heating element than the second resistor 11 is, and either (2) the heat capacity of the third resistor 12 is set to be larger than that of the second resistor 11, or (3) the positive resistance-temperature coefficient of the third resistor 12 is set to be smaller than that of the second resistor 11. That is, the third resistor 12 is set to satisfy at least one of the conditions (2) and (3) while the condition (1) is satisfied.

In this embodiment, the third resistor embedded in the sheath large-diameter portion 20 is located inside the housing 3 at a position away from the first and second resistors 10 and 11, thus providing a structure substantially free from heating from the front end portion of the sheath 2 and a thermal influence from a combustion chamber in which the front end of the sheath faces.

With the above structure, the heat capacity of the large-diameter portion 20 of the sheath in which the third resistor 12 is embedded for controlling the temperature in the after glow state can be set larger than that of the second resistor 11. Therefore, energization control by the third resistor 12 can be delayed from control by the second resistor 11. With this structure, the glow plug heating temperature can be controlled by the third resistor 12 to a temperature lower than the saturation temperature controlled by the second resistor 11. For example, the after glow over 10 minutes can be controlled by the glow plug itself, and preheating cost can be largely reduced.

The relationship between the energization time and the heating temperature of the glow plug 1 is represented by a characteristic curve a in FIG. 3. As compared with a conventional characteristic curve b, it is readily understood that the glow plug of the present invention has a fast heating function, a temperature saturation function, and after glow for a long period of time.

According to another characteristic feature of the present invention, in the first, second, and third resistors 10, 11, and 12 connected in series with each other and embedded in the sheath 2, the second resistor 11 is made of a material (e.g., an iron-based material such as mild steel) having a larger positive resistance-temperature coefficient than that of the third resistor 12. That is, when the positive resistance-temperature coefficients of the first, second, and third resistors 10, 11, and 12 are given as $\alpha 1$, $\alpha 2$, and $\alpha 3$, the materials are selected to satisfy condition $\alpha 1 < \alpha 3 < \alpha 2$.

In this embodiment, the above relationship between the positive resistance-temperature coefficients of the resistors 10, 11, and 12 is achieved by the following structure. More specifically, as shown in FIG. 1, the large-diameter portion 20 is formed at the rear end portion of the sheath 2, and the large-diameter third resistor 12 is arranged therein. However, the present invention is not limited to this arrangement. The same effect can be obtained by first, second, third resistors 10, 11, and 12 which are connected in series with each other and embedded in a straight sheath 2 if they have positive resistance-temperature coefficients satisfying the above relationship.

Figure 4:
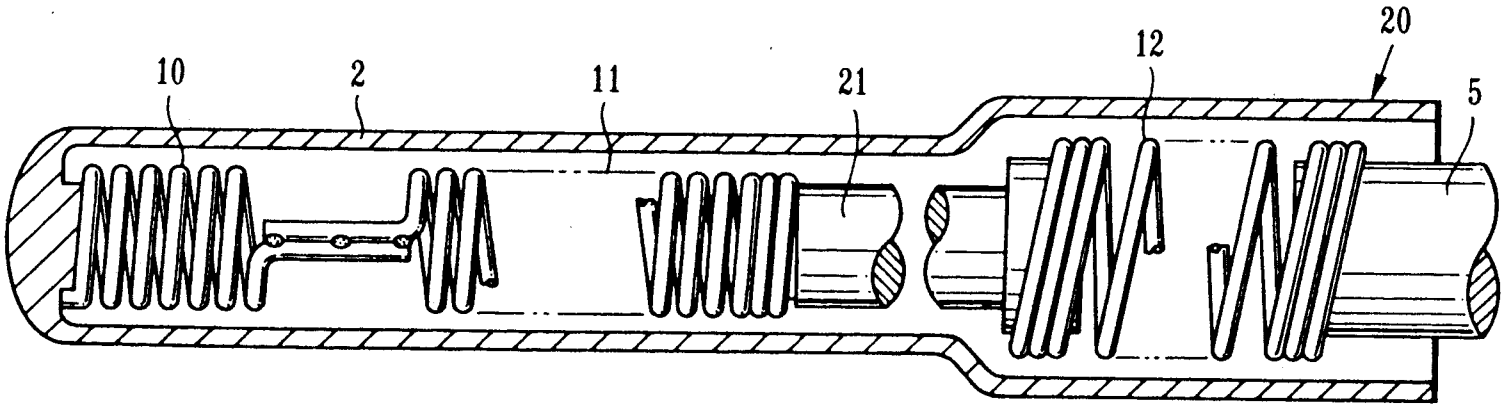
FIGS. 4 and 5 are an enlarged sectional view of the main part and a schematic sectional view of an overall structure, respectively, of a glow plug according to another embodiment of the present invention.
Figure 5:
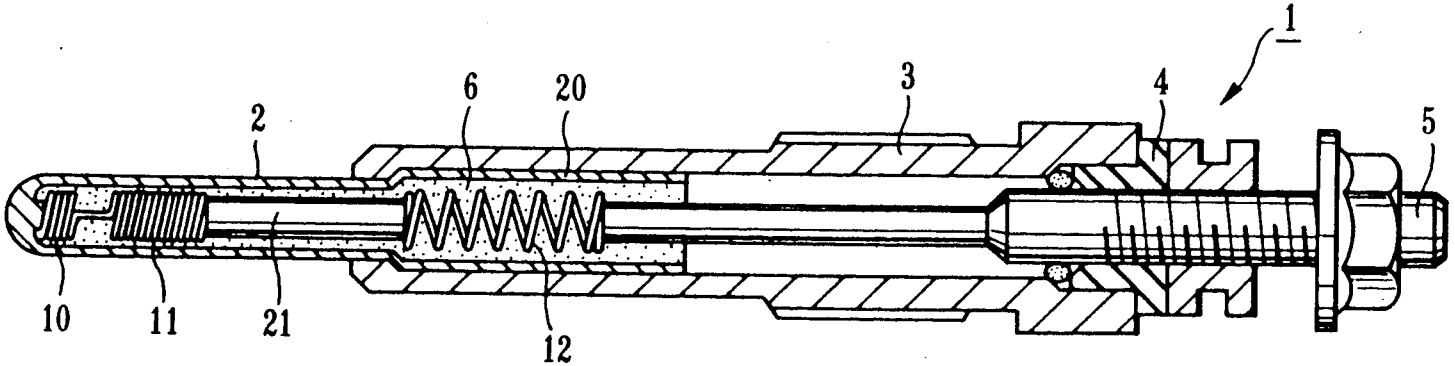

The present invention is not limited to the particular embodiment described above. The shapes, structures, and the like of the respective members of the glow plug 1 can be arbitrarily changed and modified. The glow plug structure is not limited to the one illustrated in FIGS. 1 and 2. For example, as shown in FIGS. 4 and 5, connecting portions of second and third resistors 11 and 12 may be connected through a rod member 21 made of an iron-based material and having a large cross section. This rod member 21 has almost no electric resistance.

In the diesel engine glow plug according to the present invention, as has been described above, the first resistor serving as a heating element and the second and third resistors connected in series with one end of the first resistor and made of a material having a positive resistance-temperature coefficient larger than that of the first resistor are embedded in the heat-resistant insulating powder filled in the sheath. The rear end portion of this sheath has a larger diameter than the front end of the sheath in which the first and second resistors are embedded. The heat capacity of the portion embedded with the third resistor can be set larger than that of the portion embedded with the second resistor although the structure is simple at low cost. Therefore, control by the third resistor is delayed from control by the second resistor, so that fast heating and appropriate saturation temperature control can be performed. The heating temperature can be set lower than the saturation temperature by the control function of the third resistor. Therefore, many advantages such as after glow for a long period of time can be provided.

According to the present invention, since the second resistor is made of a material having a positive resistance-temperature coefficient larger than that of the third resistor, control by the third resistor can be delayed from that by the second resistor, so that fast heating and temperature control at an appropriate temperature can be performed. At the same time, the heating temperature at the time of starting of the engine can be lower than the saturation temperature, thus achieving after glow for a long period of time.

In the above embodiment, the resistance-temperature coefficient of the first resistor need not be limited to the positive resistance-temperature coefficient.

What is claimed is:

1. A glow plug for a diesel engine, comprising a first resistor serving as a heating element, second and third resistors connected in series with said first resistor, each resistor being made of a material having a positive resistance-temperature coefficient, and said second and third resistors having a positive resistance-temperature coefficient larger than that of said first resistor; a sheath which incorporates said first, second, and third resistors, said sheath having a front end housing the first resistor and a rear end housing the third resistor; a heat-resistant insulating powder filled in said sheath to insulate said first, second, and third resistors from each other; and a cylindrical housing for holding said sheath, said housing being second to the rear end of said sheath;

wherein means for increasing a heat capacity is arranged at a given sheath portion incorporating said third resistor therein to increase the heat capacity of said given sheath portion to be larger than those of other sheath portions incorporating the first and second resistors.

2. A glow plug according to claim 1, wherein said means for increasing the heat capacity comprises means for increasing a diameter of said given portion having said third resistor therein larger than a diameter of the front end of said sheath.

3. A glow plug according to claim 1, wherein said first and second resistors comprise spiral resistors whose spiral portions oppose each other with a predetermined gap therebetween in order to provide a thermal time lag therebetween.

4. A glow plug according to claim 1, wherein said second and third resistors comprise spiral resistors whose spiral portions oppose each other with a predetermined gap therebetween in order to provide a thermal time lag therebetween.

5. A glow plug according to claim 1, wherein the positive resistance-temperature coefficients $\alpha 1$, $\alpha 2$, and $\alpha 3$ of said first, second, and third resistors satisfy condition $\alpha 1 < \alpha 3 < \alpha 2$.

6. A glow plug according to claim 1, wherein said third resistor is located in the portion of said sheath which is received by said housing.

7. A glow plug according to claim 1, further comprising an electrically conductive rod member coupled between said second and third resistors.

* * * * *